US007533728B2

(12) United States Patent
Winslow et al.

(10) Patent No.: US 7,533,728 B2
(45) Date of Patent: May 19, 2009

(54) BALL OPERATED BACK PRESSURE VALVE

(75) Inventors: Donald Winslow, Duncan, OK (US); Alton Branch, Comanche, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 301 days.

(21) Appl. No.: 11/619,779

(22) Filed: Jan. 4, 2007

(65) Prior Publication Data

US 2008/0164028 A1 Jul. 10, 2008

(51) Int. Cl.
*E21B 34/06* (2006.01)

(52) U.S. Cl. ..... 166/318; 166/325; 166/332.4

(58) Field of Classification Search ..... 166/373, 166/318, 325, 328, 329, 332.4; 251/76, 149.1
See application file for complete search history.

(56) References Cited

U.S. PATENT DOCUMENTS

| | | | | |
|---|---|---|---|---|
| 2,223,509 | A | 12/1940 | Brauer | |
| 2,230,589 | A | 2/1941 | Driscoll | |
| 2,407,010 | A | 9/1946 | Hudson | |
| 2,472,466 | A | 6/1949 | Counts et al. | |
| 2,647,727 | A | 8/1953 | Edwards | |
| 2,659,438 | A * | 11/1953 | Schnitter | 166/154 |
| 2,675,082 | A | 4/1954 | Hall | |
| 2,849,213 | A | 8/1958 | Failing | |
| 2,919,709 | A | 1/1960 | Schwegman | |
| 3,051,246 | A | 8/1962 | Clark, Jr. et al. | |
| 3,086,591 | A * | 4/1963 | Sexton | 166/151 |
| 3,193,010 | A | 7/1965 | Bielstein | |
| 3,277,962 | A | 10/1966 | Flickinger et al. | |
| 3,948,322 | A | 4/1976 | Baker | |
| 3,948,588 | A | 4/1976 | Curington et al. | |
| 3,951,208 | A | 4/1976 | Delano | |
| 3,954,138 | A * | 5/1976 | Miffre | 166/188 |
| 4,105,069 | A | 8/1978 | Baker | |
| 4,271,916 | A | 6/1981 | Williams | |
| 4,300,633 | A | 11/1981 | Stewart | |
| RE31,190 | E | 3/1983 | Detroit et al. | |
| 4,469,174 | A | 9/1984 | Freeman | |
| 4,519,452 | A | 5/1985 | Tsao et al. | |
| 4,531,583 | A | 7/1985 | Revett | |

(Continued)

FOREIGN PATENT DOCUMENTS

EP 0 419 281 A2 3/1991

(Continued)

OTHER PUBLICATIONS

U.S. Appl. No. 11/230,807, filed Sep. 20, 2005, Webb et al.

(Continued)

*Primary Examiner*—Kenneth Thompson
(74) *Attorney, Agent, or Firm*—John W. Wustenberg; Baker Botts, L.L.P.

(57) ABSTRACT

A method for selectively closing a downhole one way check valve, the method having the following steps: attaching the valve to a casing; locking the valve in an open configuration; running the casing and the valve into the wellbore; reverse circulating a composition down an annulus defined between the casing and the wellbore; injecting a plurality of balls into the annulus; unlocking the valve with the plurality of balls; and closing the valve.

20 Claims, 10 Drawing Sheets

U.S. PATENT DOCUMENTS 4,548,271 A 10/1985 Keller
4,555,269 A 11/1985 Rao et al.
4,671,356 A 6/1987 Barker et al.
4,676,832 A 6/1987 Childs et al.
4,791,988 A 12/1988 Trevillion
4,961,465 A 10/1990 Brandell
5,024,273 A 6/1991 Coone et al.
5,117,910 A 6/1992 Brandell et al.
5,125,455 A 6/1992 Harris et al.
5,133,409 A 7/1992 Bour et al.
5,147,565 A 9/1992 Bour et al.
5,188,176 A 2/1993 Carpenter
5,213,161 A 5/1993 King et al.
5,273,112 A 12/1993 Schultz
5,297,634 A 3/1994 Loughlin
5,318,118 A 6/1994 Duell
5,323,858 A 6/1994 Jones et al.
5,361,842 A 11/1994 Hale et al.
5,484,019 A 1/1996 Griffith
5,494,107 A 2/1996 Bode
5,507,345 A 4/1996 Wehunt, Jr. et al.
5,559,086 A 9/1996 Dewprashad et al.
5,571,281 A 11/1996 Allen
5,577,865 A 11/1996 Manrique et al.
5,641,021 A 6/1997 Murray et al.
5,647,434 A 7/1997 Sullaway et al.
5,671,809 A 9/1997 McKinzie
5,718,292 A 2/1998 Heathman et al.
5,738,171 A 4/1998 Szarka
5,749,418 A 5/1998 Mehta et al.
5,762,139 A 6/1998 Sullaway et al.
5,797,454 A * 8/1998 Hipp ..... 166/196
5,803,168 A 9/1998 Lormand et al.
5,829,526 A 11/1998 Rogers et al.
5,875,844 A 3/1999 Chatterji et al.
5,890,538 A 4/1999 Beirute et al.
5,893,415 A * 4/1999 Ricks ..... 166/277
5,897,699 A 4/1999 Chatterji et al.
5,900,053 A 5/1999 Brothers et al.
5,913,364 A 6/1999 Sweatman
5,968,255 A 10/1999 Mehta et al.
5,972,103 A 10/1999 Mehta et al.
6,060,434 A 5/2000 Sweatman et al.
6,063,738 A 5/2000 Chatterji et al.
6,098,710 A 8/2000 Rhein-Knudsen et al.
6,138,759 A 10/2000 Chatterji et al.
6,143,069 A 11/2000 Brothers et al.
6,167,967 B1 1/2001 Sweatman
6,196,311 B1 3/2001 Treece et al.
6,204,214 B1 3/2001 Singh et al.
6,244,342 B1 6/2001 Sullaway et al.
6,258,757 B1 7/2001 Sweatman et al.
6,296,059 B1 * 10/2001 Leeb et al. ..... 166/317
6,311,775 B1 11/2001 Allamon et al.
6,318,472 B1 11/2001 Rogers et al.
6,349,771 B1 * 2/2002 Luke ..... 166/386
6,367,550 B1 4/2002 Chatterji et al.
6,431,282 B1 8/2002 Bosma et al.
6,454,001 B1 9/2002 Thompson et al.
6,457,524 B1 10/2002 Roddy
6,467,546 B2 10/2002 Allamon et al.
6,481,494 B1 11/2002 Dusterhoft et al.
6,484,804 B2 11/2002 Allamon et al.
6,488,088 B1 12/2002 Kohli et al.
6,488,089 B1 12/2002 Bour et al.
6,488,763 B2 12/2002 Brothers et al.
6,540,022 B2 4/2003 Dusterhoft et al.
6,622,798 B1 9/2003 Rogers et al.
6,666,266 B2 12/2003 Starr et al.
6,679,336 B2 1/2004 Musselwhite et al.
6,725,935 B2 4/2004 Szarka et al.
6,732,797 B1 5/2004 Watters et al.
6,758,281 B2 7/2004 Sullaway et al.
6,802,374 B2 10/2004 Edgar et al.
6,808,024 B2 10/2004 Schwendemann et al.
6,810,958 B2 11/2004 Szarka et al.
2001/0045288 A1 * 11/2001 Allamon et al. ..... 166/373
2003/0000704 A1 1/2003 Reynolds
2003/0029611 A1 2/2003 Owens
2003/0072208 A1 4/2003 Rondeau et al.
2003/0192695 A1 10/2003 Dillenbeck et al.
2004/0079553 A1 4/2004 Livingstone
2004/0084182 A1 5/2004 Edgar et al.
2004/0099413 A1 5/2004 Arceneaux
2004/0104050 A1 6/2004 Järvelä et al.
2004/0104052 A1 6/2004 Livingstone
2004/0177962 A1 9/2004 Bour
2004/0231846 A1 11/2004 Griffith et al.
2005/0061546 A1 3/2005 Hannegan
2006/0016599 A1 1/2006 Badalamenti et al.
2006/0016600 A1 1/2006 Badalamenti et al.
2006/0042798 A1 3/2006 Badalamenti et al.
2006/0076135 A1 4/2006 Rogers et al.
2006/0086499 A1 4/2006 Badalamenti et al.
2006/0086502 A1 4/2006 Reddy et al.
2006/0086503 A1 4/2006 Reddy et al.
2006/0131018 A1 6/2006 Rogers et al.

FOREIGN PATENT DOCUMENTS

GB 2193741 2/1988
GB 2327442 A 11/1999
GB 2348828 A 10/2000
RU SU 571584 9/1977
RU SU 1420139 A1 8/1988
RU SU1534183 1/1990
RU SU 1716096 A1 2/1992
RU SU 1723309 A1 3/1992
RU SU 1758211 A1 8/1992
RU SU 1774986 11/1992
RU SU 1778274 11/1992
RU 1542143 C 12/1994
RU 2067158 9/1996
RU 2 086 752 C1 8/1997
WO WO 2004/104366 12/2004
WO WO 2005/083229 A1 9/2005
WO WO 2006/008490 A1 1/2006
WO WO 2006/064184 A1 6/2006

OTHER PUBLICATIONS

Foreign communication related to a counterpart application dated May 13, 2008.

Griffith, et al., "Reverse Circulation of Cement on Primary Jobs Increases Cement Column Height Across Weak Formations," Society of Petroleum Engineers, SPE 25440, 315-319, Mar. 22-23, 1993.

Filippov, et al., "Expandable Tubular Solutions," Society of Petroleum Engineers, SPE 56500, Oct. 3-6, 1999.

Daigle, et al., "Expandable Tubulars: Field Examples of Application in Well Construction and Remediation," Society of Petroleum Engineers, SPE 62958, Oct. 1-4, 2000.

Carpenter, et al., "Remediating Sustained Casing Pressure by Forming a Downhole Annular Seal With Low-Melt-Point Eutectic Metal," IADC/SPE 87198, Mar. 2-4, 2004.

Halliburton Casing Sales Manual, Section 4, Cementing Plugs, pp. 4-29 and 4-30, Oct. 6, 1993.

G.L. Cales, "The Development and Applications of Solid Expandable Tubular Technology," Paper No. 2003-136, Petroleum Society's Canadian International Petroleum Conference 2003, Jun. 10-12, 2003.

Gonzales, et al., "Increasing Effective Fracture Gradients by Managing Wellbore Temperatures," IADC/SPE 87217, Mar. 2-4, 2004.

Fryer, "Evaluation of the Effects of Multiples in Seismic Data From the Gulf Using Vertical Seismic Profiles," SPE 25540, 1993.

Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication, Oct. 12, 2005.
Foreign Communication, Sep. 30, 2005.
Foreign Communication, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the StrataLock Stabilization System", 1998.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "POZMIX® A Cement Additive", 1999.
Foreign Communication, Dec. 9, 2005.
Foreign Communication, Feb. 24, 2005.
R. Marquaire et al., "Primary Cementing by Reverse Circulation Solves Critical Problem in the North Hassi-Messaoud Field, Algeria", SPE 1111, Feb. 1966.
Foreign Communication, Dec. 27, 2005.
Foreign Communication, Feb. 23, 2006.
Foreign Communication, Jan. 8, 2007.
Foreign Communication, Jan. 17, 2007.

* cited by examiner

BALL OPERATED BACK PRESSURE VALVE

BACKGROUND

The present invention relates to reverse cementing operations useful in subterranean formations, and more particularly, to the use of ball operated back pressure valves in reverse circulation operations.

After a well for the production of oil and/or gas has been drilled, casing may be run into the wellbore and cemented. In conventional cementing operations, a cement composition is displaced down the inner diameter of the casing. The cement composition is displaced downwardly into the casing until it exits the bottom of the casing into the annular space between the outer diameter of the casing and the wellbore. It is then pumped up the annulus until a desired portion of the annulus is filled.

The casing may also be cemented into a wellbore by utilizing what is known as a reverse-cementing method. The reverse-cementing method comprises displacing a cement composition into the annulus at the surface. As the cement is pumped down the annulus, drilling fluids ahead of the cement composition around the lower end of the casing string are displaced up the inner diameter of the casing string and out at the surface. The fluids ahead of the cement composition may also be displaced upwardly through a work string that has been run into the inner diameter of the casing string and sealed off at its lower end. Because the work string by definition has a smaller inner diameter, fluid velocities in a work string configuration may be higher and may more efficiently transfer the cuttings washed out of the annulus during cementing operations.

The reverse circulation cementing process, as opposed to the conventional method, may provide a number of advantages. For example, cementing pressures may be much lower than those experienced with conventional methods. Cement composition introduced in the annulus falls down the annulus so as to produce little or no pressure on the formation. Fluids in the wellbore ahead of the cement composition may be bled off through the casing at the surface. When the reverse-circulating method is used, less fluid may be handled at the surface and cement retarders may be utilized more efficiently.

In reverse circulation methods, it may be desirable to stop the flow of the cement composition when the leading edge of the cement composition slurry is at or just inside the casing shoe. In order to determine when to cease the reverse circulation fluid flow, the leading edge of the slurry is typically monitored to determine when it arrives at the casing shoe. Logging tools and tagged fluids (by density and/or radioactive sources) have been used monitor the position of the leading edge of the cement slurry. If a significant volume of the cement slurry enters the casing shoe, clean-out operations may need to be conducted to ensure that cement inside the casing has not covered targeted production zones. Position information provided by tagged fluids is typically available to the operator only after a considerable delay. Thus, even with tagged fluids, the operator is unable to stop the flow of the cement slurry into the casing through the casing shoe until a significant volume of cement has entered the casing. Imprecise monitoring of the position of the leading edge of the cement slurry can result in a column of cement in the casing 100 feet to 500 feet long. This unwanted cement may then be drilled out of the casing at a significant cost.

SUMMARY

The present invention relates to reverse cementing operations useful in subterranean formations, and more particularly, to the use of ball operated back pressure valves in reverse circulation operations.

According to one aspect of the invention, there is provided a method for selectively closing a downhole one way check valve, the method having the following steps: attaching the valve to a casing; locking the valve in an open configuration; running the casing and the valve into the wellbore; reverse circulating a composition down an annulus defined between the casing and the wellbore; injecting a plurality of balls into the annulus; unlocking the valve with the plurality of balls; and closing the valve.

A further aspect of the invention provides a valve having a variety of components including: a plug removably connected to a housing; a plug seat; and a baffle having a plurality of holes. When the plug is connected to the housing, the valve is in an open position, and fluid may flow through the valve. When the holes in the baffle become plugged, the plug becomes disconnected from the housing and moves into the plug seat, restricting flow through the valve. Another aspect of the invention provides a system for reverse-circulation cementing a casing in a wellbore, wherein the system has a valve and a plurality of balls. The valve may have a plug removably connected to a housing, a plug seat, and a baffle having a plurality of holes. The plug may be connected to the housing, the valve may be in an open position, and fluid may flow through the valve. When the holes in the baffle become plugged, the plug may become disconnected from the housing and move into the plug seat, restricting flow through the valve. The balls may be sized to cause the holes in the baffle to become plugged.

The objects, features, and advantages of the present invention will be readily apparent to those skilled in the art upon a reading of the following description of the preferred embodiments.

BRIEF DESCRIPTION OF THE DRAWINGS

A more complete understanding of the present disclosure and advantages thereof may be acquired by referring to the following description of non-limitative embodiments with reference to the attached drawings, wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION

The present invention relates to reverse cementing operations useful in subterranean formations, and more particularly, to the use of ball operated back pressure valves in reverse circulation operations.

Figure 1A:
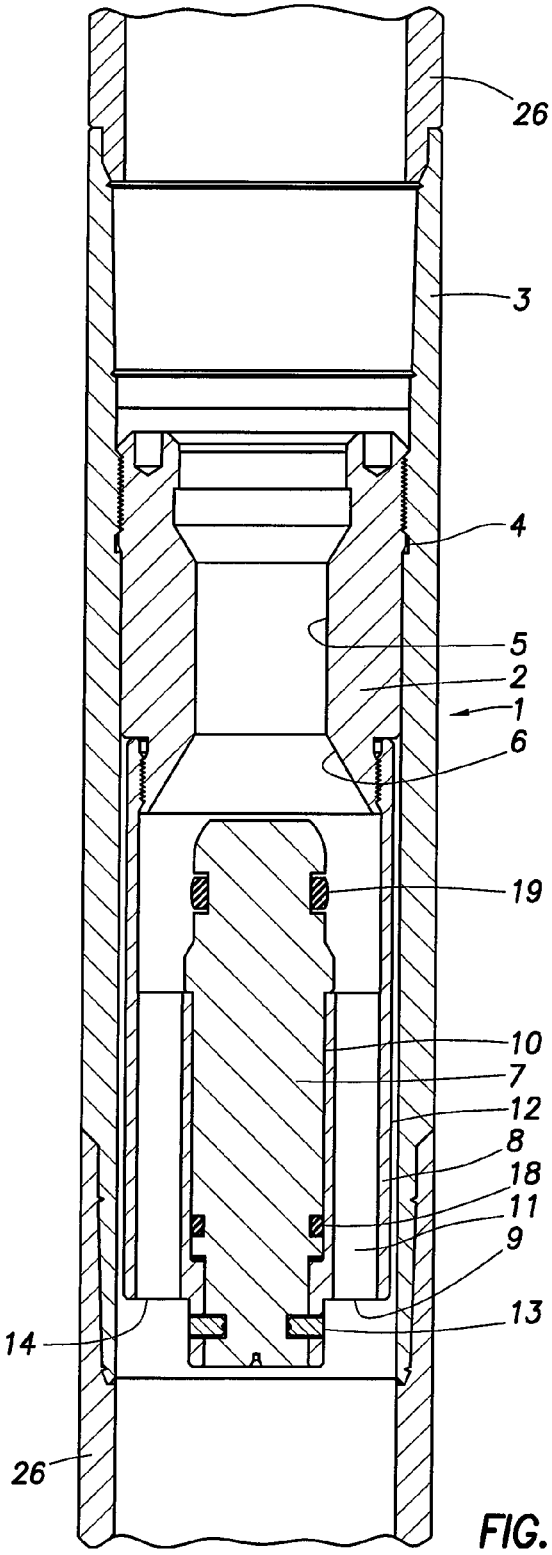
FIG. 1A is a cross-sectional, side view of a valve having a plug suspended outside of a plug seat, such that the valve is in an open position.

FIG. 1A illustrates a cross-sectional side view of a valve 1. This embodiment of the valve 1 has a plug seat 2, which is a cylindrical structure positioned within the inner diameter of a sleeve 3. A seal 4 closes the interface between the outer diameter of the plug seat 2 and the inner diameter of the sleeve 3. The seal 4 may be an O-ring seal, Halliburton Weld A™ Thread-Locking Compound, or any other seal. The plug seat 2 has an inner bore 5 for passing fluid through the plug seat 2. At the mouth of the inner bore 5, the plug seat 2 has a conical lip 6 for receiving a plug 7 when the valve is in a closed position.

The valve 1 also has a housing 8 that suspends the plug 7 outside the plug seat 2. The housing 8 has a baffle section 9 (shown more clearly in FIG. 1B). In the illustrated embodiment, the plug 7 has a cylindrical structure having an outside diameter larger than an inside diameter of the inner bore 5 of the plug seat 2, but slightly smaller than an inside diameter of an inner wall 10 of the housing 8. This leaves a flow conduit 11 extending between an outer wall 12 of the housing 8 and the inner wall 10, which abuts the plug 7.

When the plug 7 is suspended outside the plug seat 2 of the valve 1, as illustrated in FIG. 1A, the valve 1 is locked in an open configuration. The plug 7 may be suspended outside the plug seat 2 by a shear pin or pins 13, which may connect the plug 7 to the inner wall 10 of the housing 8.

Figure 1B:
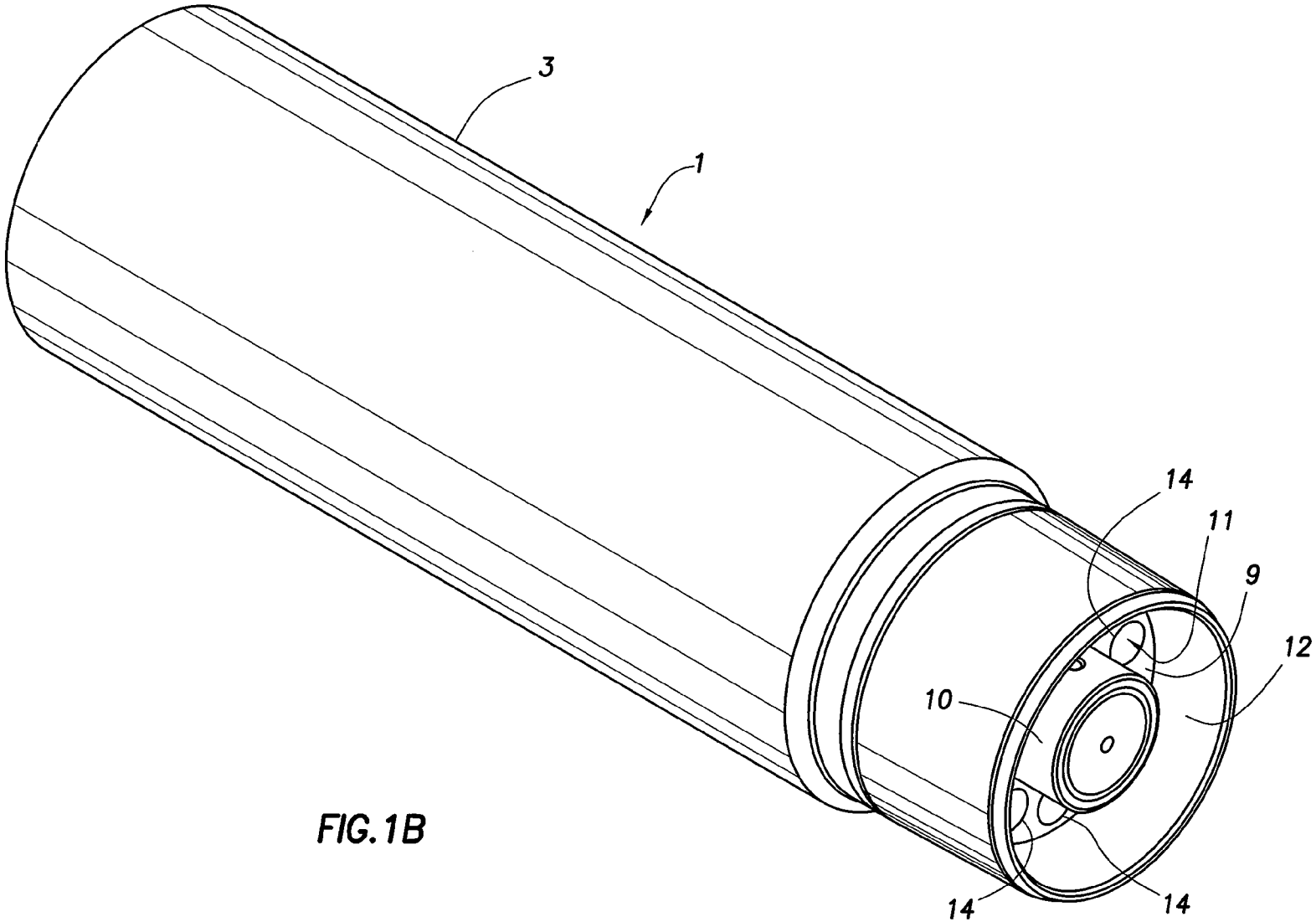
FIG. 1B is a perspective view of the valve of FIG. 1A.

Referring now to FIG. 1B, the flow conduit 11 extends through the housing 8, between the inner wall 10 and the outer wall 12. The baffle section 9 is an opening to the flow conduit 11. The baffle section 9 has a plurality of holes 14. The holes 14 may have a radial pattern around the baffle section 9. The holes 14 and the flow conduit 11 allow for fluid passage around the plug 7.

Figure 2A:
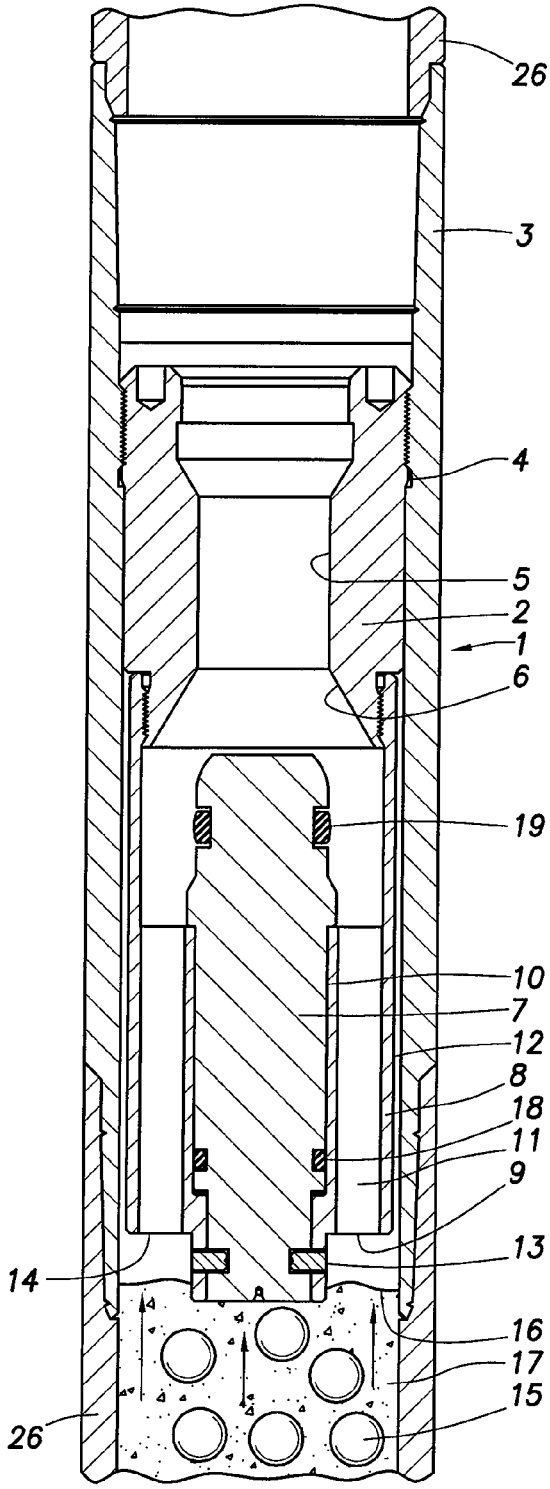
FIG. 2A is a cross-sectional, side view of the valve of FIG. 1A, as a cement composition and balls flow through the valve.
Figure 2B:
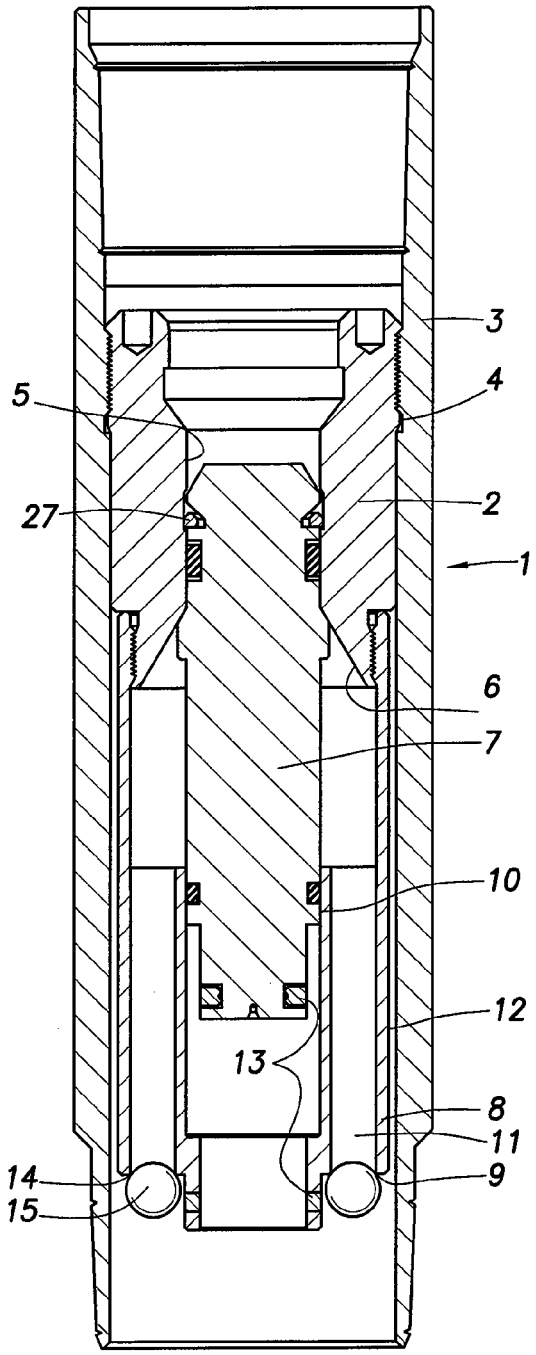
FIG. 2B is a cross-sectional, side view of the valve of FIG. 1A, showing the plug within the plug seat, such that the valve is in a closed position.

FIGS. 2A and 2B illustrate cross-sectional side views of a valve similar to that illustrated in FIG. 1A, wherein FIG. 2A shows the valve in a locked, open configuration and FIG. 2B shows the valve in an unlocked, closed configuration. In FIG. 2A, the plug 7 is suspended outside of the plug seat 2 to hold the valve 1 in an open position. Pins 13 retain the plug 7 outside of the plug seat 2. In FIG. 2B, the plug 7 is seated in the plug seat 2, within the conical lip 6 of the plug seat 2 to close the valve 1.

An example of a reverse cementing process of the present invention is described with reference to FIGS. 2A and 2B. The valve 1 is run into the wellbore in the configuration shown in FIG. 2A. With the plug 7 held outside of the plug seat 2, such that the valve 1 is in an open position, fluid from the wellbore is allowed to flow freely up through the valve 1, wherein it passes through the holes 14 of the baffle section 9 and through the flow conduit 11 of the housing 8. As casing 26 is run into the wellbore, the wellbore fluids flow through the open valve 1 to fill the inner diameter of the casing 26 above the valve 1. After the casing 26 is run into the wellbore to its target depth, a cement operation may be performed on the wellbore. In particular, a cement composition slurry may be pumped in the reverse-circulation direction, down the annulus defined between the casing 26 and the wellbore. Returns from the inner diameter of the casing 26 may be taken at the surface. The wellbore fluid enters the sleeve 3 at its lower end below the valve 1 illustrated in 3A and flows up through the valve 1 as the cement composition flows down the annulus.

Balls 15 may be used to close the valve 1, when a leading edge 16 of cement composition 17 reaches the valve 1. Balls 15 may be inserted ahead of the cement composition 17 when the cement composition is injected into the annulus at the surface. These balls 15 may be located in a fluid that is just ahead of the cement, or even at the leading edge 16 of the cement. The balls 15 flow down the annulus, around the bottom of the casing 26, and back up into the valve 1 to close it. As shown in FIG. 2A, the balls 15 may be pumped at the leading edge 16 of the cement composition 17 until the leading edge 16 passes through the flow conduit 11 of the housing 8 of the valve 1. When the leading edge 16 of the cement composition 17 passes through baffle section 9 of the housing 8, the balls 15 seat and seal off in the holes 14, preventing any further flow through the holes 14. At this point, hydrostatic pressure from the column of cement begins to build up underneath the housing 8. This pressure works across an O-ring 18 on the outer diameter of the plug 7. As the differential pressure created between the cement and lighter fluid above the valve 1 increases, the pins 13 may shear, allowing the plug 7 to shift upward into the plug seat 2 so that the plug 7 extends into the conical lip 6. The shear pins 13 may shear at any predetermined shear value. The shear value may change from one application to the next. If the predetermined shear value is low enough, the shear pins 13 may shear without a complete seal between the balls 15 and the holes 14. In fact, when desired, the shear pins 13 may shear when only a portion of the holes 14 are occupied by balls 15. In the instances where the shear pins 13 shear without a complete seal, the back pressure buildup created by the reduced flow of some balls 15 may create the pressure necessary to shear the pins 13. The end of the plug 7 contains a seal 19 that seals inside the plug seat 2. This seal 19 is a back up seal to the balls 15 that are sealing flow through the holes 14 in the event the balls 15 do not create a complete positive seal.

The plug seat 2 and the housing 8 may be attached to a sleeve 3 that will make-up into the casing 26 as an integral part of the casing 26. This allows for casing 26 to be attached below it. The plug seat 2, the housing 8, and the plug 7 may be made of drillable material such as aluminum to facilitate drilling out these components with a roller-cone rock bit if required.

FIG. 2B illustrates a configuration of the valve 1 after the plug 7 has been pumped into the plug seat 2. The plug 7 then prevents flow through the inner bore 5 of the valve 1, effectively closing the valve 1. The closed valve 1 prevents the cement composition 17 from flowing up through the valve 1 into the inner diameter of the casing 26 above the valve 1. The plug 7 may be locked in place using a locking ring 27 (shown only in FIG. 2B) or any other locking device. This allows the valve 1 to be locked in a closed position with or without the presence of continued pressure. Once the valve 1 is closed, casing head pressure can be removed from the well. However, the locking ring 27 or other locking device may not be necessary to maintain the plug 7 in position. The valve 1 will remain in a closed position so long as adequate pressure is maintained.

Figure 3A:
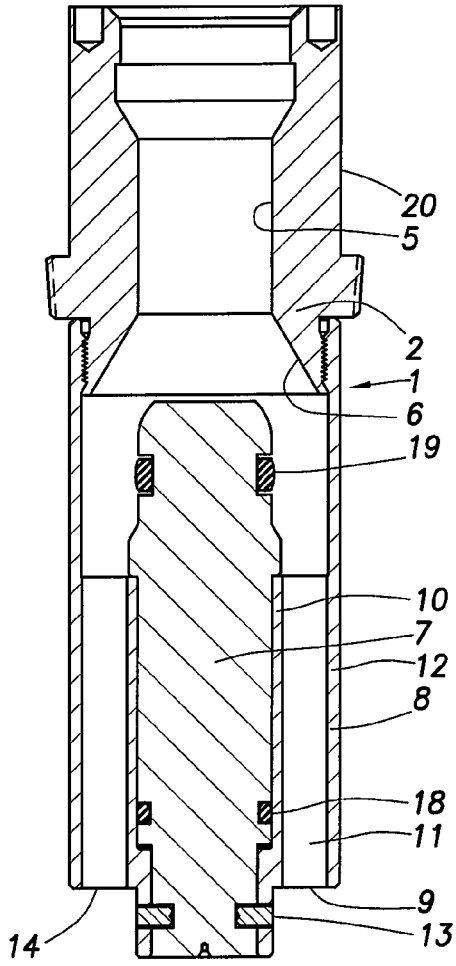
FIG. 3A is a cross-sectional, side view of an alternate embodiment of a valve having a plug suspended outside of a plug seat, such that the valve is in an open position.
Figure 3B:
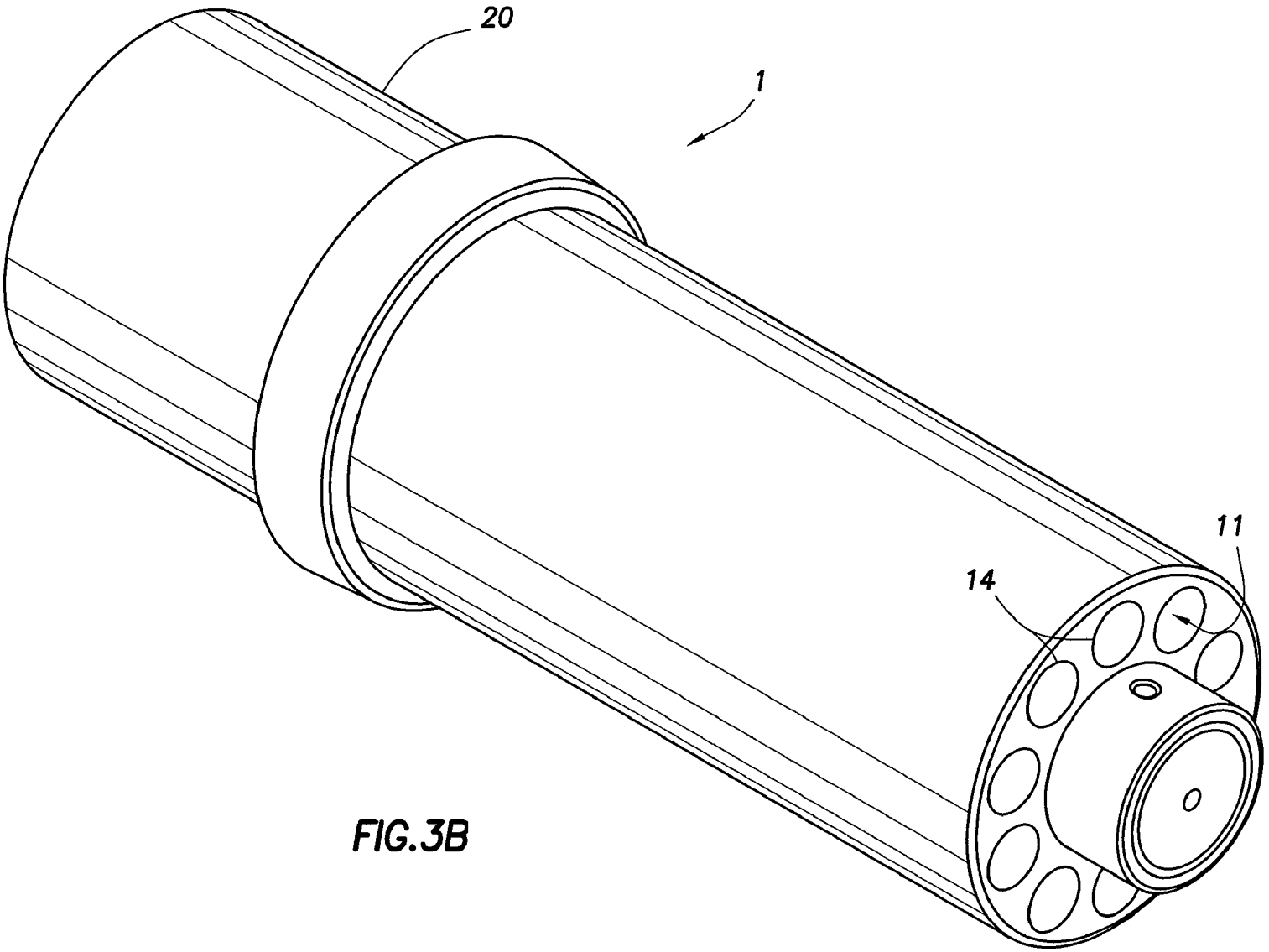
FIG. 3B is a perspective view of the valve of FIG. 3A.

Referring to FIGS. 3A and 3B, an alternate embodiment is shown. This embodiment allows the valve 1 to be screwed between two joints of casing as an insert. To do so, a valve seat 20 with a casing thread on the outer diameter may be provided. This would allow the valve 1 to be screwed into a casing collar. The thread may be coated with Halliburton Weld A™ Thread-Locking Compound to create a seal around the valve seat 20.

Figure 4A:
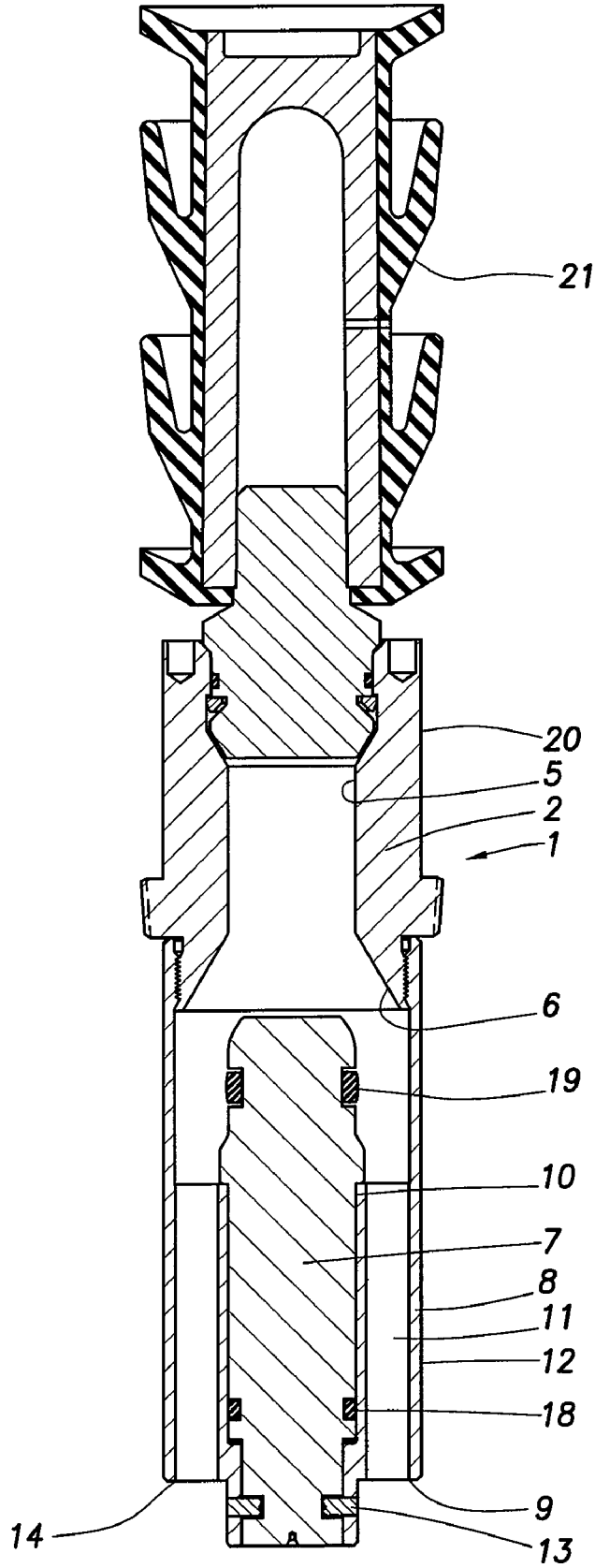
FIG. 4A is a cross-sectional, side view of an alternate embodiment of a valve showing a plug within a plug seat, such that the valve is in an open position.
Figure 4B:
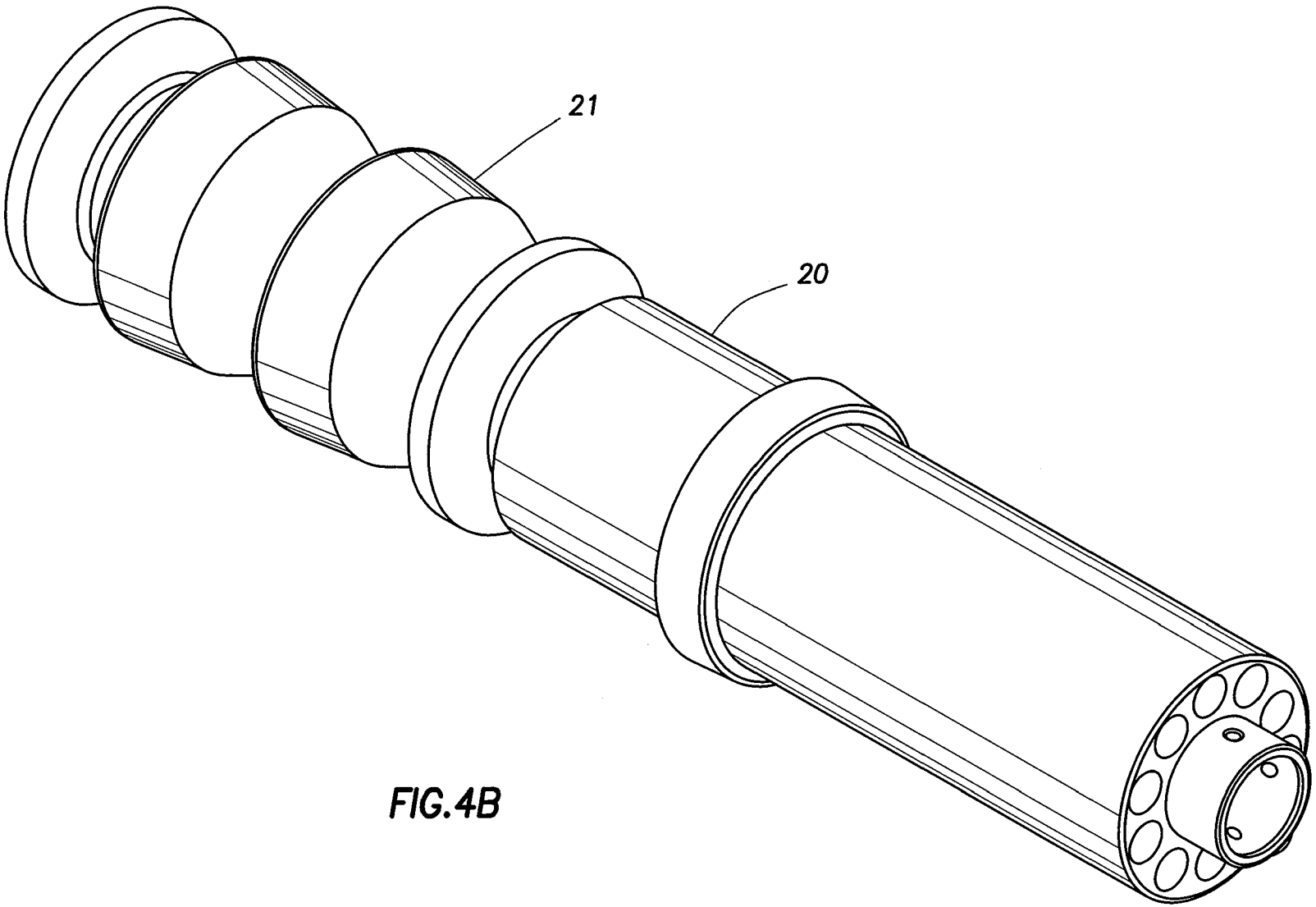
FIG. 4B is a perspective view of the valve of FIG. 4A.
Figure 5A:
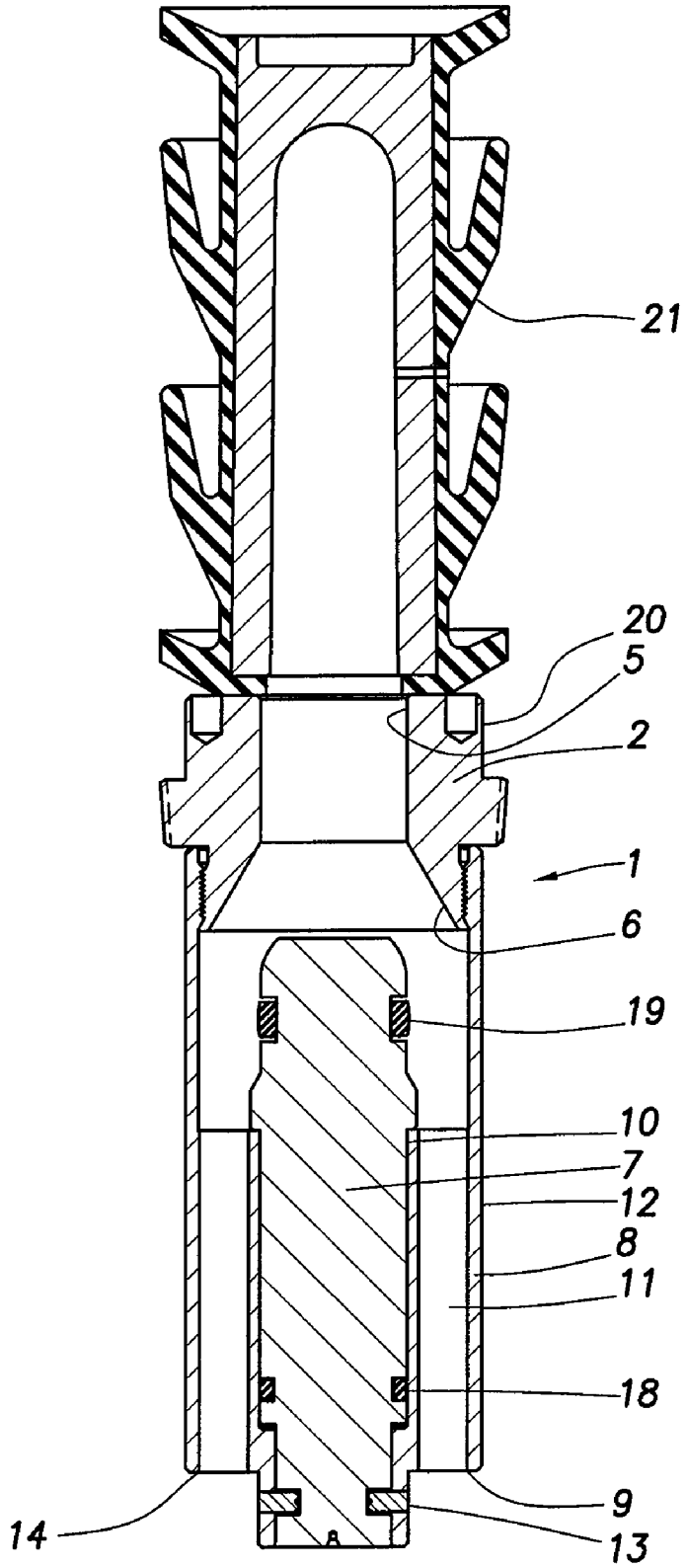
FIG. 5A is a cross-sectional, side view of an alternate embodiment of a valve showing a plug within a plug seat, such that the valve is in an open position
Figure 5B:
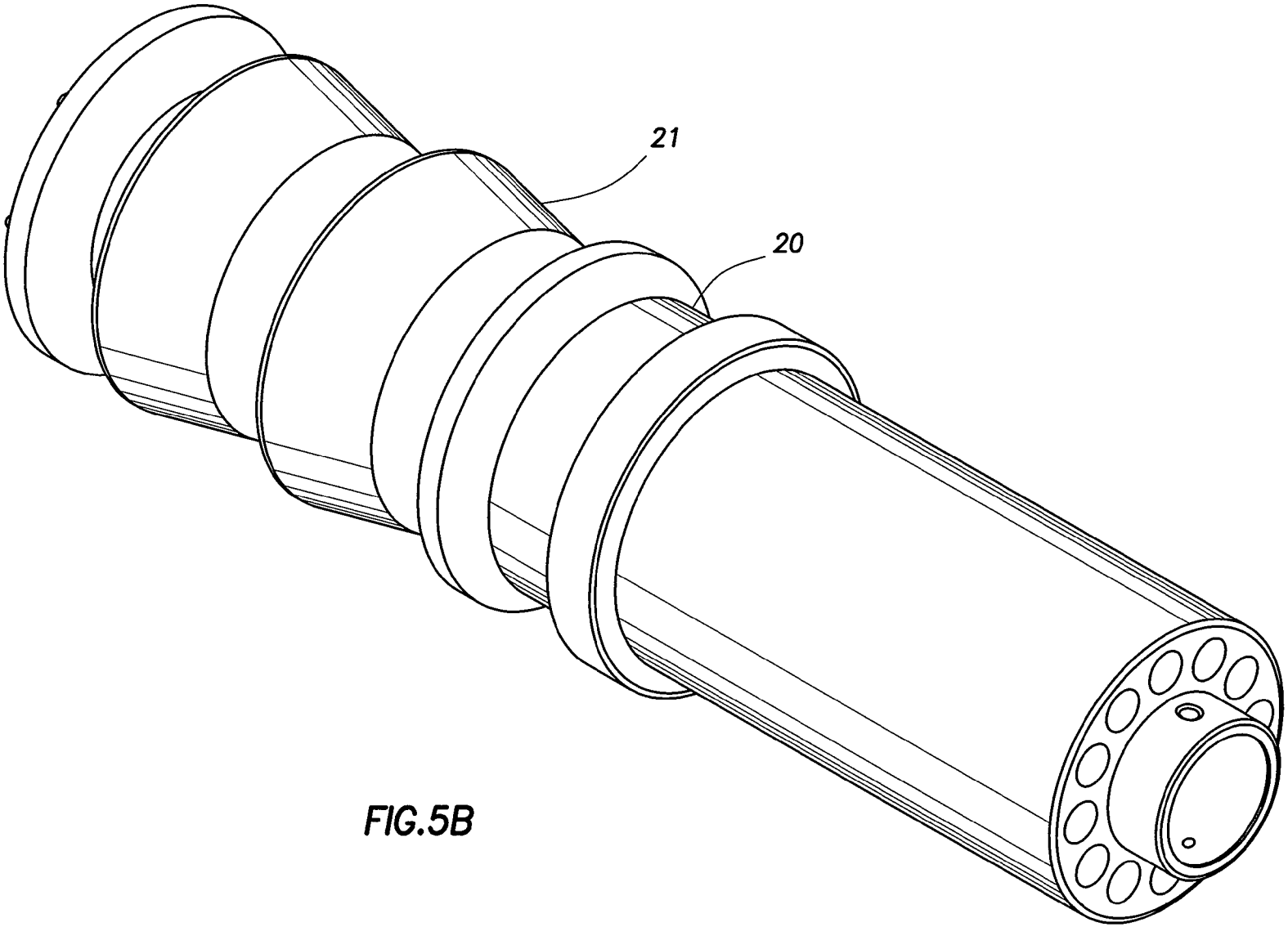
FIG. 5B is a perspective view of the valve of FIG. 5A.

The valve 1 may accept a cementing plug 21 in the upper end of the plug seat 2. The cementing plug 21 is illustrated in FIGS. 4A and 4B. This allows for cementing the casing in place by conventional cementing operations, where the cement is pumped down the inside of the casing and back up the wellbore-to-casing annulus. While a latch-down cementing plug is illustrated, the cementing plug 21 may be a standard cementing plug that lands and seals on top of the valve 1, as illustrated in FIGS. 5A and 5B.

Figure 6:
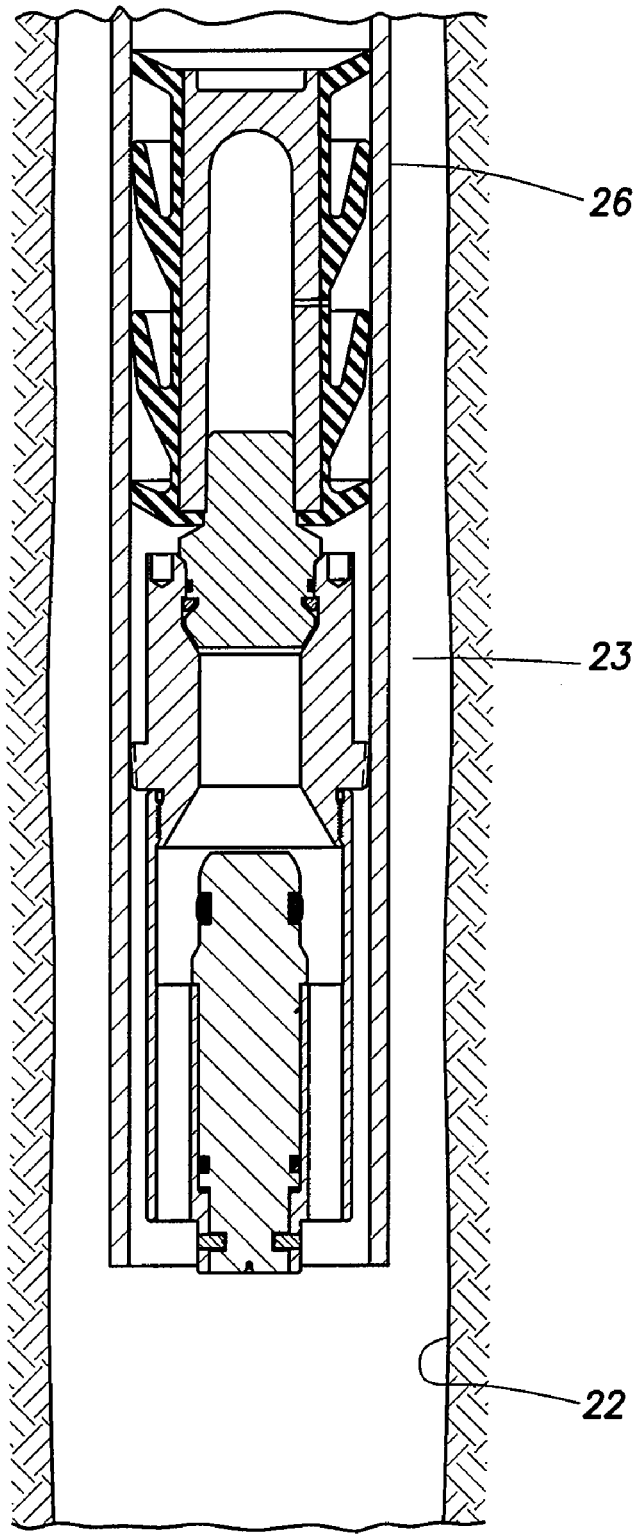
FIG. 6 is a cross-sectional side view of a valve and casing run into a wellbore, wherein a cementing plug is in the casing above the valve.

Referring to FIG. 6, a cross-sectional side view of a valve similar to that illustrated in FIGS. 2A and 2B is illustrated. The valve 1 and casing 26 are shown in a wellbore 22, wherein an annulus 23 is defined between the casing 26 and the wellbore 22. In this embodiment, a standard cementing plug or a latch-down plug is run into the inner diameter of the casing 26 to a position immediately above the valve 1. The valve 1 can be secured to the bottom joint of casing as a guide shoe or located above the bottom of the casing 26 similar to where a float collar would be located.

Figure 7A:
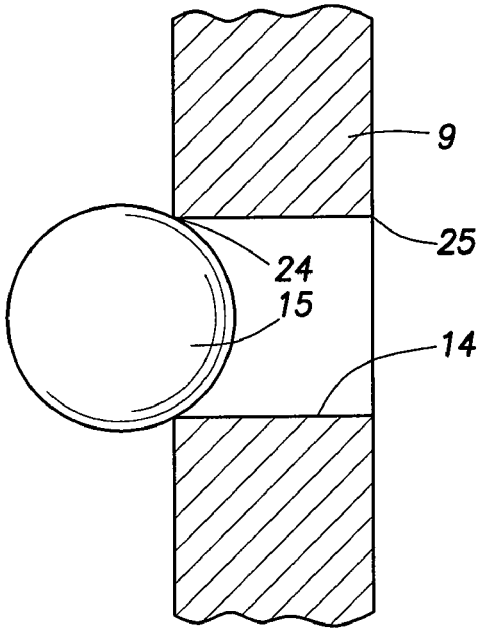
FIG. 7A is a cross-sectional, side view of a portion of a wall of a baffle section of a plug, wherein the wall has a cylindrical hole and a spherical ball is stuck in the hole.
Figure 7B:
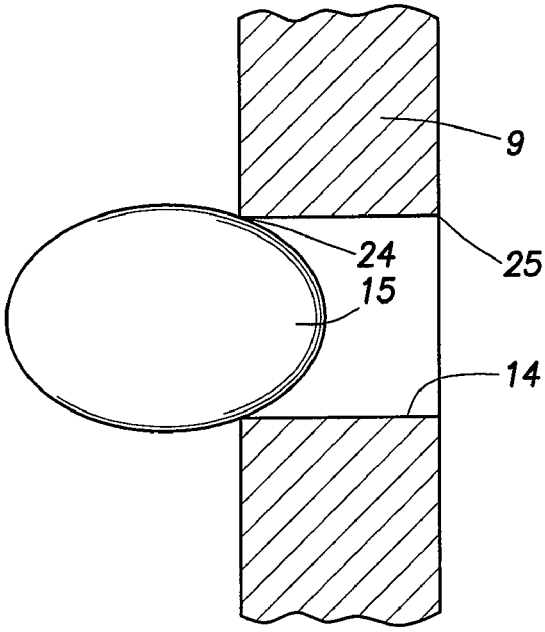
FIG. 7B is a cross-sectional, side view of a portion of a wall of a baffle section of a plug, wherein the wall has a cylindrical hole and an ellipsoidal ball is stuck in the hole.

FIGS. 7A and 7B illustrate cross-sectional, side views of a portion of the baffle section 9 of the plug 7. In particular, a hole 14 is shown extending through the baffle section 9. In this embodiment, the hole 14 is cylindrical. In FIG. 7A, the illustrated ball 15 is a sphere having an outside diameter slightly larger than the diameter of the hole 14. The ball 15 plugs the hole 14 when a portion of the ball 15 is pushed into the hole 14 as fluid flows through the hole 14. In FIG. 7B, the illustrated ball 15 is an ellipsoid wherein the greatest outside circular diameter is slightly larger than the diameter of the hole 14. The ellipsoidal ball 15 plugs the hole 14 when a portion of the ball 15 is pushed into the hole 14 as fluid flows through the hole 14.

Figure 8A:
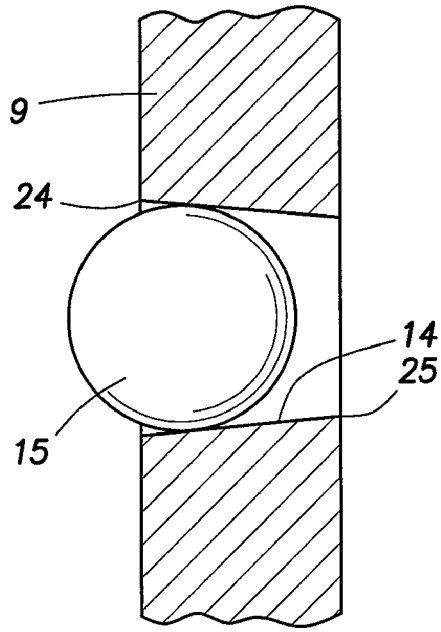
FIG. 8A is a cross-sectional, side view of a portion of a wall of a baffle section of a plug, wherein the wall has a conical hole and a spherical ball is stuck in the hole.
Figure 8B:
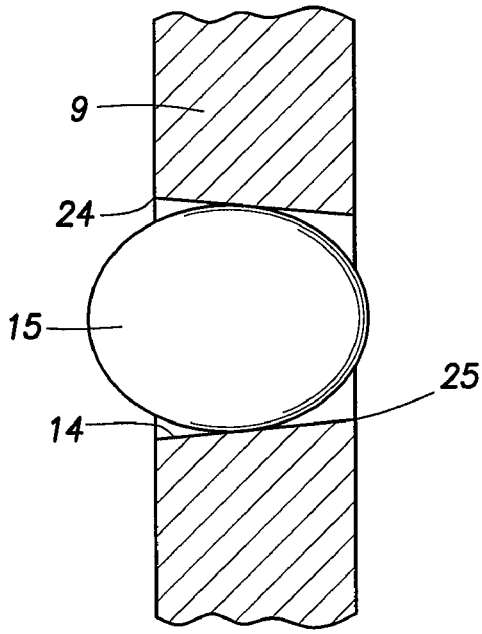
FIG. 8B is a cross-sectional, side view of a portion of a wall of a baffle section of a plug, wherein the wall has a conical hole and an ellipsoidal ball is stuck in the hole.

FIGS. 8A and 8B illustrate cross-sectional, side views of a portion of the baffle section 9 of the plug 7. In particular, a hole 14 is shown extending through the baffle section 9. In this embodiment, the hole 14 is conical. In FIG. 8A, the illustrated ball 15 is a sphere having an outside diameter slightly smaller than the diameter of the conical hole 14 at an exterior surface 24 of the baffle section 9 and slightly larger than the diameter of the conical hole 14 at an interior surface 25 of the baffle section 9. The spherical ball 15 plugs the hole 14 when at least a portion of the ball 15 is pushed into the hole 14 as fluid flows through the hole 14. In FIG. 8B, the illustrated ball 15 is an ellipsoid wherein the greatest outside circular diameter is slightly smaller than the diameter of the conical hole 14 at the exterior surface 24 of the baffle section 9 and slightly larger than the diameter of the conical hole 14 at the interior surface 25 of the baffle section 9. The ellipsoidal ball 15 plugs the conical hole 14 when at least a portion of the ball 15 is pushed into the hole 14 as fluid flows through the hole 14.

In one embodiment of the invention, the valve 1 is made, at least in part, of the same material as the sleeve 3. Alternative materials, such as steel, composites, cast-iron, plastic, cement, and aluminum, also may be used for the valve so long as the construction is rugged to endure the run-in procedure and environmental conditions of the wellbore.

According to one embodiment of the invention, the balls 15 may have an outside diameter of approximately 0.75 inches so that the balls 15 may clear the annular clearance of the casing collar and wellbore (e.g., 7.875 inches×6.05 inches). The composition of the balls 15 may be of sufficient structural integrity so that downhole pressures and temperatures do not cause the balls 15 to deform and pass through the holes 14. The balls 15 may be constructed of plastic, rubber, phenolic, steel, neoprene plastics, rubber coated steel, rubber coated nylon, or any other material known to persons of skill in the art.

The present invention does not require that pressure be applied to the casing to deactivate the valve to the closed position after completion of reverse cementing. There may be instances when pumping equipment may not be able to lift the weight of the cement in order to operate a pressure operated float collar or float shoe.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for selectively closing a downhole one way check valve, the method comprising:

attaching the valve to a casing;

locking the valve in an open configuration;

running the casing and the valve into the wellbore;

reverse circulating a composition down an annulus defined between the casing and the wellbore;

injecting a plurality of balls into the annulus;

unlocking the valve with the plurality of balls; and closing the valve.

2. The method for selectively closing a downhole one-way check valve of claim 1, wherein the composition is a cement composition.

3. The method for selectively closing a downhole one-way check valve of claim 1, wherein the locking the valve in an open configuration comprises suspending a plug from a housing.

4. The method for selectively closing a downhole one-way check valve of claim 3, wherein the plug is suspended from the housing with one or more shear pins.

5. The method for selectively closing a downhole one way check valve of claim 1, wherein the injecting a plurality of balls into the annulus comprises injecting the plurality of balls at a leading edge of the cement composition.

6. The method for selectively closing a downhole one way check valve of claim 1, wherein the unlocking the valve with the plurality of balls comprises trapping at least a portion of the plurality of balls in a baffle connected to a housing of the valve, wherein the trapped portion of the plurality of balls restricts fluid flow through the baffle.

7. The method for selectively closing a downhole one-way check valve of claim 6, wherein the restricted fluid flow through the baffle causes fluid pressure to move a plug into a plug seat.

8. The method for selectively closing a downhole one way check valve of claim 1, wherein the balls are injected at a leading edge of a cement composition, such that the valve is closed prior to the passage of the cement composition therethrough.

9. A valve comprising:

a plug removably connected to a housing;

a plug seat; and a baffle having a plurality of holes;

wherein when the plug is connected to the housing, the valve is in an open position, and fluid may flow through the valve; and wherein when the holes in the baffle become plugged, the plug becomes disconnected from the housing and moves into the plug seat, restricting flow through the valve.

10. The valve of claim 9, wherein the plug is removably connected to the housing via one or more shear pins.

11. The valve of claim 9, wherein the holes of the baffle are sized to prevent balls from flowing therethrough.

12. The valve of claim 9, further comprising an O-ring on the plug to further seal the valve and restrict flow therethrough.

13. The valve of claim 9, wherein the seat, the housing, and the plug are comprised of a drillable material.

14. A system for reverse-circulation cementing a casing in a wellbore, the system comprising:

a valve comprising:

a plug removably connected to a housing;

a plug seat; and a baffle having a plurality of holes;

wherein when the plug is connected to the housing, the valve is in an open position, and fluid may flow through the valve; and wherein when the holes in the baffle become plugged, the plug becomes disconnected from the housing and moves into the plug seat, restricting flow through the valve;

a plurality of balls, wherein the balls are sized to cause the holes in the baffle to become plugged.

15. The system of claim 14, wherein the balls are located within a cement composition, at a leading edge of the cement composition.

16. The system of claim 14, wherein the balls are located in a fluid just ahead of a leading edge of a cement composition.

17. The system of claim 14, further comprising a cementing plug, such that the system may be used for conventional cementing operations.

18. The system of claim 14, wherein the plurality of balls comprises spheres.

19. The system of claim 14, wherein the plurality of balls comprises spheres comprising an outside diameter of approximately 0.75 inches.

20. The system of claim 14, wherein the seat, the housing, and the plug are comprised of a drillable material.

* * * * *